US006170938B1

(12) United States Patent
Kenyon

(10) Patent No.: US 6,170,938 B1
(45) Date of Patent: Jan. 9, 2001

(54) METHOD AND APPARATUS FOR REFILLING PRINTER INK CARTRIDGES

(75) Inventor: Robin George Blunden Kenyon, Sydney (AU)

(73) Assignee: Calidad Holdings Pty Ltd., New South Wales (AU)

( * ) Notice: Under 35 U.S.C. 154(b), the term of this patent shall be extended for 0 days.

(21) Appl. No.: 09/246,945

(22) Filed: Feb. 9, 1999

(30) Foreign Application Priority Data

Feb. 10, 1998 (AU) ..... PP 1765

(51) Int. Cl.[7] ..... B41J 2/175
(52) U.S. Cl. ..... 347/85
(58) Field of Search ..... 347/85, 86, 87; 277/35, 37, 39, 70, 72 R, 75, 76, 48; 215/329; 141/363

(56) References Cited

U.S. PATENT DOCUMENTS 3,245,569 * 4/1966 Essich ..... 215/329
3,246,647 * 4/1966 Kapeker ..... 141/363
5,329,294 * 7/1994 Ontawar et al. ..... 347/87
5,883,652 * 3/1999 Moser et al. ..... 347/85

* cited by examiner

*Primary Examiner*—N. Le
*Assistant Examiner*—Anh T. N. Vo
(74) *Attorney, Agent, or Firm*—Smith, Gambrell & Russell, LLP

(57) ABSTRACT

Disclosed is an apparatus and associated method for refilling a used ink cartridge of an ink jet printer with ink. Such cartridges have an aperture (30) through which ink can be inserted. Surrounding the aperture is a funnel (21) having a resiliently deformable washer (22) therein. The washer (22) has a tapered aperture (23) defining therebeneath a void space (25) which can have air entrapped therein. A refilling apparatus to be associated with an ink refill bottle includes a plug element (10) including a tip portion (13) to be received within the aperture (30). A widened portion (18) bears upon the washer (23) so as to expel any air entrapped therein to prevent such air passing into the ink cartridge when refilling with ink.

19 Claims, 5 Drawing Sheets

METHOD AND APPARATUS FOR REFILLING PRINTER INK CARTRIDGES

FIELD OF THE INVENTION

The following invention relates to a method and an apparatus for refilling a printer ink cartridge with ink.

Ink cartridges for use with ink jet printers are designed to be used once and discarded. As replacement ink cartridges are expensive, it has been known to refill used cartridges with new ink as an alternative. However, it is fundamental to the operation of known printers that little or no air is allowed to pass through the printer-head as otherwise poor print or even no print can result.

It has hitherto been difficult to refill used ink cartridges without entrainment of air in critical areas of the cartridge.

OBJECT OF THE INVENTION

It the object of the present invention to overcome or substantially ameliorate the above disadvantage and/or more generally to provide a method and apparatus for refilling used ink cartridges.

DISCLOSURE OF THE INVENTION

There is disclosed herein an apparatus for use in refilling a used ink cartridge with ink, wherein the ink cartridge has a funnel having situated therein a resiliently deformable washer having a void space therein which might receive air, said apparatus being in the form of a plug element having a longitudinal extent and a passageway throughout that extent and through which ink can press into said cartridge, the plug element further having a tip portion and a wide portion delimited from the tip portion by a ramp portion, the ramp portion and the wide portion being adapted, upon insertion thereof into the resilient washer, to deform same so as to expel entrained air from said void space.

Preferably, the tip portion is dimensioned so as to be sealingly received by an aperture in the ink cartridge.

Preferably, the plug element is essentially circular in transverse cross section.

Preferably, the ramp portion is frustoconical.

Preferably, the longitudinal passageway is adapted to receive the nozzle of an ink refiller bottle.

Preferably, the plug element is formed of a resiliently deformable material.

There is further disclosed herein a method of refilling a used ink cartridge with ink, the ink cartridge having an ink funnel, the method including the steps of forming an air hole in the ink cartridge if an air hole does not already exist therein, inserting a plug element into the funnel, which plug element has a passageway therethrough, inserting the nozzle of an ink refiller bottle partly into the passageway, injecting ink from the refiller bottle through the passageway into the ink cartridge, removing the nozzle from the passageway, and removing the plug element from the funnel.

Typically, associated with the ink funnel of the cartridge is a resiliently deformable washer element defining a void space therein and the step of inserting the plug element into the funnel includes inserting the plug element into the washer element so as to deform the same ad expel air from the void space.

Preferably, upon withdrawal of the plug element, some ink from the ink cartridge is drawn back from inside the cartridge to fill the void space of the washer, thus displacing air therefrom.

There is further disclosed herein an apparatus for use in refilling a used ink cartridge with ink, wherein the ink cartridge has a funnel having situated therein a resiliently deformable washer having a void space therein which might receive air, said apparatus being in the form of a plug element having a longitudinal extent and a passageway throughout that extent and through which ink can pass into said cartridge, the plug element further having a tip portion and a body portion, the tip portion widening toward the body portion, the tip portion being adapted, upon insertion thereof into the resilient washer, to deform same so as to expel entrained air from said void space. Preferably the plug element is formed of a resiliently deformable plastics material.

BRIEF DESCRIPTION OF THE DRAWINGS

A preferred form of the present invention will now be described by way of example with reference to the accompanying drawings wherein.

DESCRIPTION OF THE PREFERRED EMBODIMENTS

Figure 1:
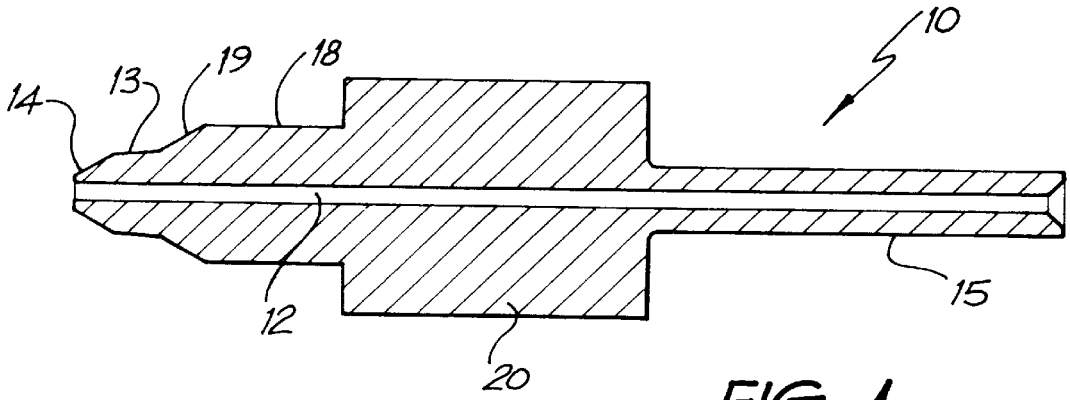
FIG. 1 is a schematic cross-sectional elevational view of a plug element.

In FIG. 1 of the accompanying drawings there is schematically depicted a plug element 10 typically fabricated from a resilient material such as PVC plastics.

Plug element 10 is generally circular in transverse cross-section and includes a longitudinal passageway 12 extending throughout its length. At one end of the plug element 10 there is provided a tip portion 13 having a tapered nose portion 14. The diameter of the tip portion 13 is sized to sealingly engage with the aperture 30 of the ink cartridge. The remote end of the plug element 10 forms a tail 15 through which the passage 12 extends. The diameter of the passage is chosen so as to sealingly receive the nozzle 16 of an ink refill bottle 17.

The plug element 10 also includes a wide portion 18 delimited from the tip portion 13 by a ramp portion 19. Ramp portion 19 is typically frustoconical. The plug element 10 further includes a body portion 20. The tail 15 is adapted to bend in use as to be described below.

The overall length of the plug element 10 is typically about 36 mm. However, this dimension could vary depending on the particular application. The tip portion 13 might slightly taper outwardly from the nose portion 14. This taper might typically be of the order of 0.3 mm. The diameter of the wide portion 18 is typically constant at about 5 mm. The longitudinal extent of the nose portion might typically be about 1.5 mm. The longitudinal extent of the tip portion 13 might typically be about 3 mm. The longitudinal extent of the ramp portion 19 might typically be about 1.5 mm whereas the longitudinal extent of the wide portion 18 might typically be about 5 mm.

Figure 2:
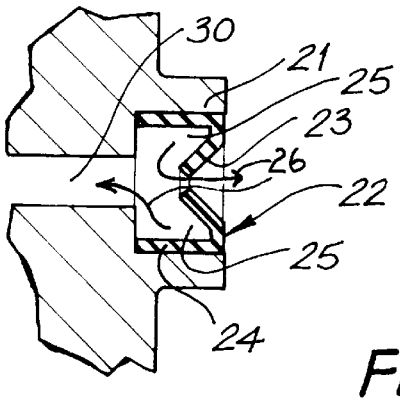
FIG. 2 is a schematic cross-sectional elevational view of a portion of an ink cartridge having a funnel which houses a resiliently deformable washer therein.
Figure 3:
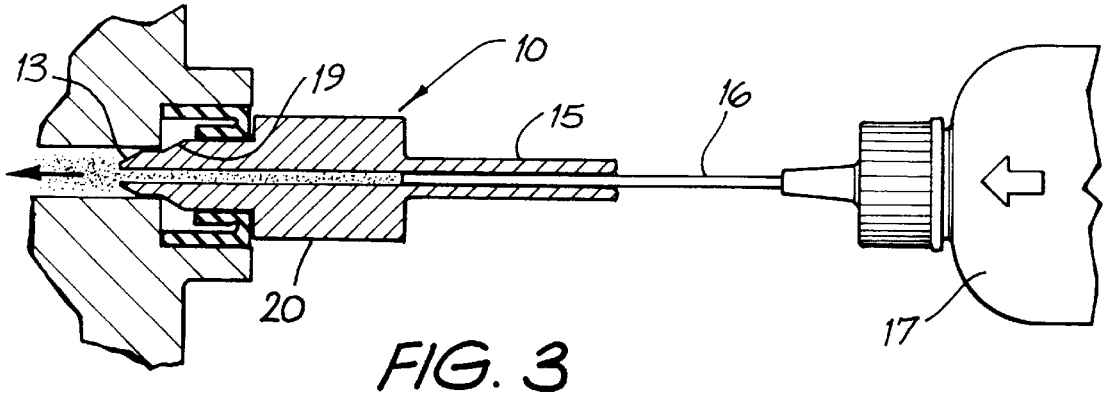
FIG. 3 is a schematic cross-sectional elevational view of a plug element inserted into the deformable washer of FIG. 2 with the nozzle of an ink refill bottle inserted into its passageway so as to inject ink into the cartridge.
Figure 4:
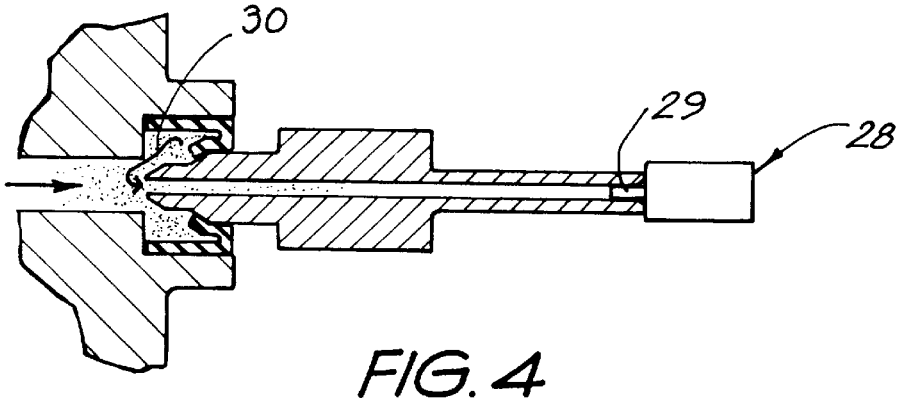
FIG. 4 is a schematic cross-sectional elevational view of the plug element of FIG. 3 being withdrawn from the washer.

The funnel portion 21 of an Epson ink cartridge 11 is shown in FIGS. 2 to 4. Within the funnel 21, there is located a resiliently deformable washer 22 having a tapered aperture 23. The funnel 21 and washer 22 are purpose-designed to cooperate with components of an Epson ink jet printer so as to enable ink from within the cartridge 11 to flow to the print head of the printer. More specifically, the printer includes a "spike" being an end projection of a tube or pipe which lead to the print head. The washer element 22 also includes a cylindrical wall 24 which rests against the inside surface of the funnel 21. The space 25 situated between the tapered aperture 23 and wall 24 is annular and forms a void within which an air pocket can occur. It is important that air is removed from this void prior to reinsertion of the cartridge into the printer as air from this void could pass to the print head and either damage the print head or cause poor print quality.

As shown in FIG. 3, upon insertion of the tip portion 13 into the cartridge, the ramp portion 19 interacts with the tapered aperture 23 to open the same into the fully opened position wherein the tapered portion is held against the outside surface of the wide portion 18. As a result of the action of tapered aperture 23 being pushed in by the ramp portion 19, air from the void space 25 is expelled out through the longitudinal passage 12 of the plug element and/or into the body of the cartridge 11 in the directions generally indicated by arrows 26 in FIG. 2. That is, most of the air from the void space 25 is expelled through the passage 12 or is forced into the body of the empty ink cartridge upon insertion of the plug element 10 as described.

A stopper 28 as shown in FIG. 4 includes a projection 29 which can be sealingly fitted within the tail end of passage 12. After filling the cartridge with ink as to be described below, the plug element 10 is withdrawn from the funnel 24 with stopper 28 in place. The close, sealing fit of the tapered aperture 23 about the plug element 10 and the fact that stopper 28 is in place, prevents any backflow of air through passage 12 and into the cartridge as the plug element 10 is withdrawn. Rather, the action of withdrawing the plug element 10 draws any air remaining in the void space 25 into the passage 12 in a direction generally indicated by arrow 30 in FIG. 4. As an alternative to providing the plug element 28, the tail portion 15 of the plug element 10 can be squeezed between the finger and thumb, so as to seal the passage 12.

Figure 5:
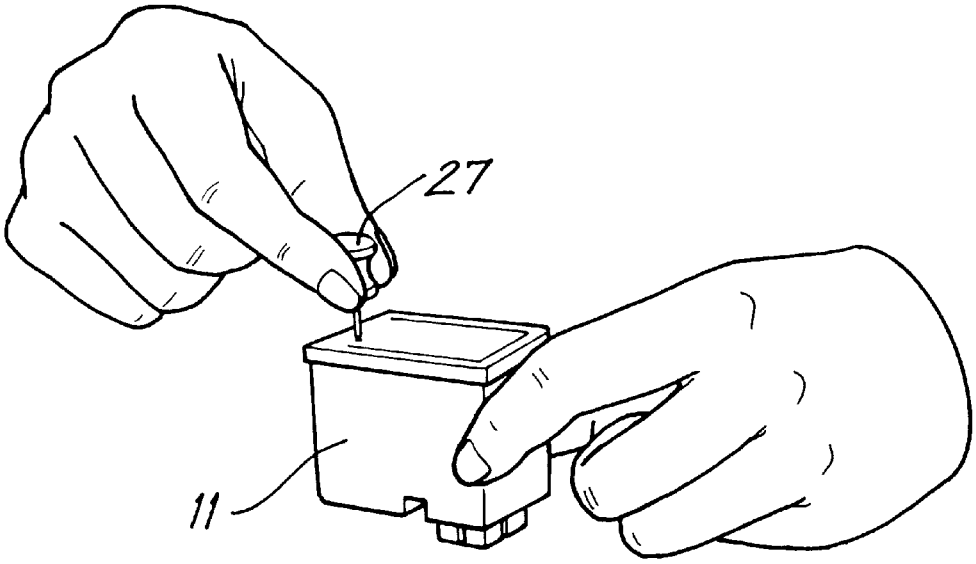
FIGS. 5, 6, 7 and 8 are schematic illustrations depicting steps taken in refilling a used ink cartridge with ink.

The method of refilling an ink cartridge is typically as follows. Firstly, and as shown in FIG. 5, if the ink cartridge does not already have a pin prick or other breathing aperture formed therein, a pin 27 can be used to make a vent hole in the cartridge. In certain cartridge models, it might be appropriate that the hole be made as close to the back edge of the cartridge top as possible.

Figure 6:
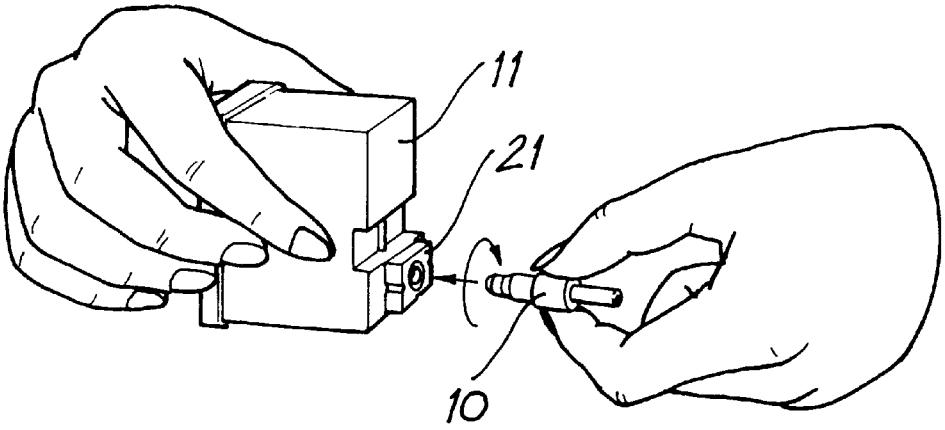

The cartridge as shown in FIG. 6 should then be placed on its side with the ink funnel 21 located at the bottom. The plug element 10 is then inserted into the funnel via the resilient washer 22. It may be necessary to twist the plug element 10 during this insertion process until it fits right in. It is during this step that most, if not all, air is removed from the void space as described above.

Figure 7:
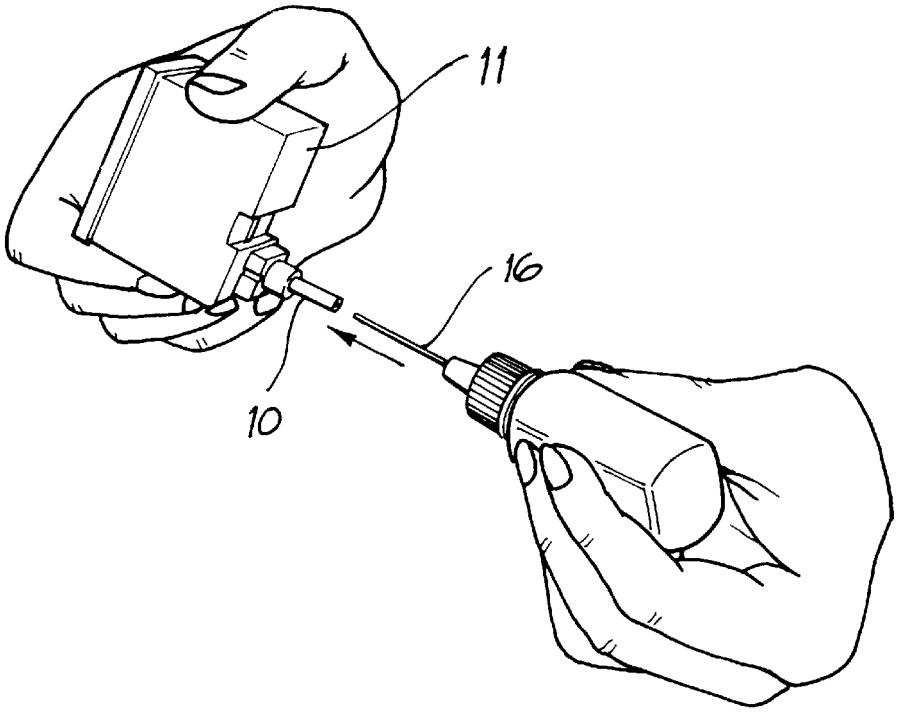

As shown in FIG. 7, and after having removed the cap from the nozzle of a refiller bottle, the bottle is held without squeezing whilst its nozzle 16 is inserted a short way into the passage 12, typically to the point where the tail portion 15 joins the body portion 20.

Figure 8:
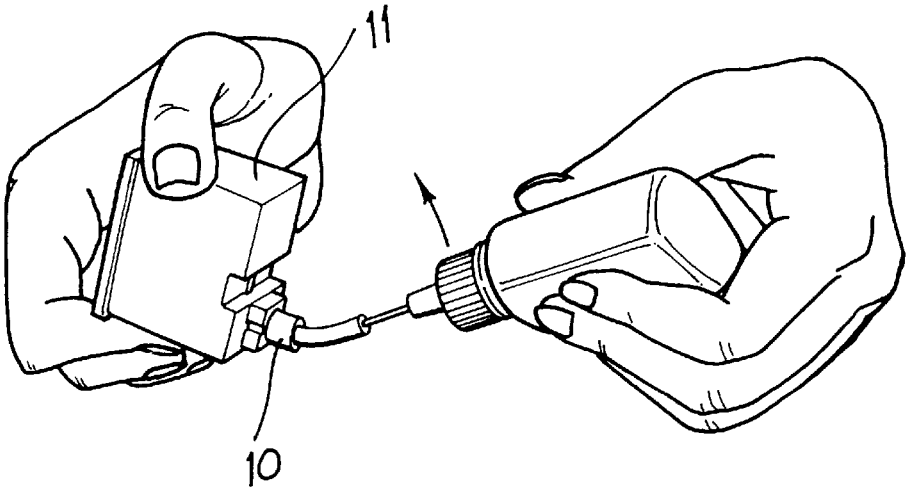

As shown in FIG. 8, the bottle should then be gently raised in the direction of the arrow such that the tail portion 15 is deformed. The body portion 20 might also deform slightly. The refiller bottle is then gently squeezed so as to inject ink through the longitudinal passage 12 into the cartridge 11. It is important during this step not to squeeze any air into the cartridge. When ink passes out of the vent hole formed by pin 27, the cartridge is full and the nozzle 16 can be withdrawn from the passage 12.

The plug element 10 should then be withdrawn as described above, either using stopper 28 or whilst simultaneously squeezing the tail portion 15.

The cartridge can then be placed right-way-up. The plug element 10 can then be removed from the funnel 21 with the stopper 28 still in place. After quickly cleaning any ink spillages, the cartridge can then be immediately reloaded into the printer. In certain printer models, the "load/eject" button of the printer can then be depressed.

Figure 9:
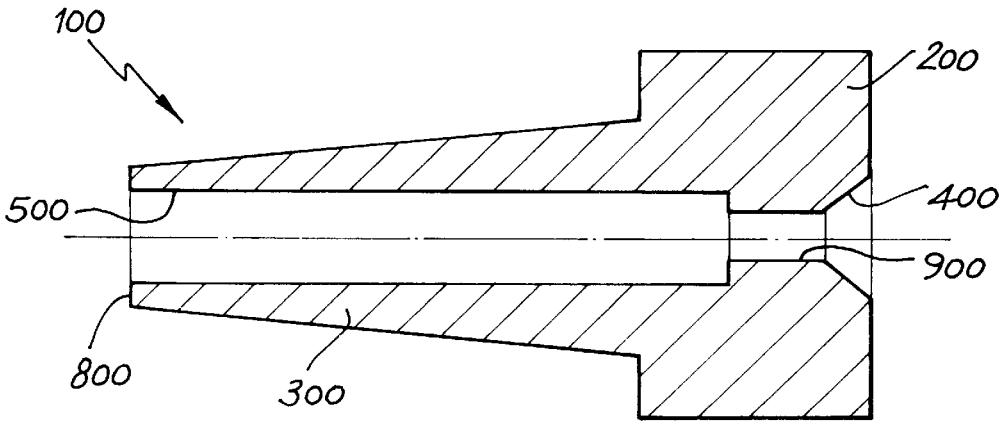
FIG. 9 is a schematic cross-sectional elevational view of an alternative plug element.
Figure 10:
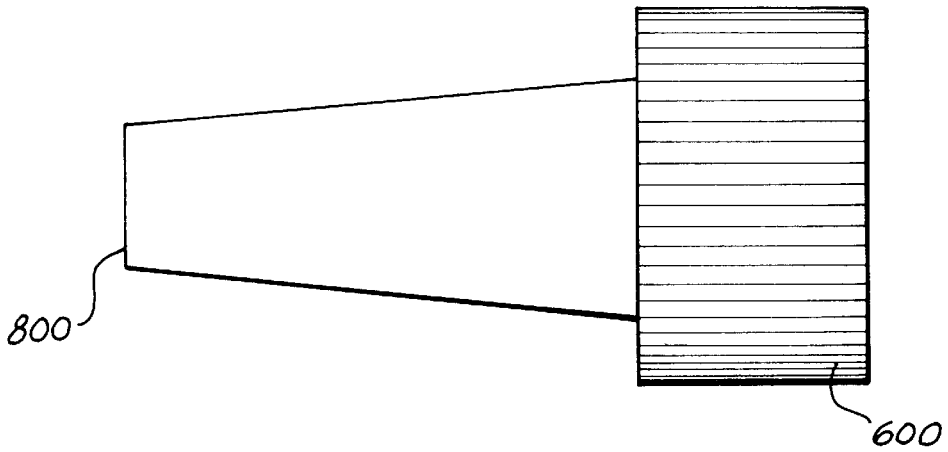
FIG. 10 is a schematic elevational view of the plug element of FIG. 9.
Figure 11:
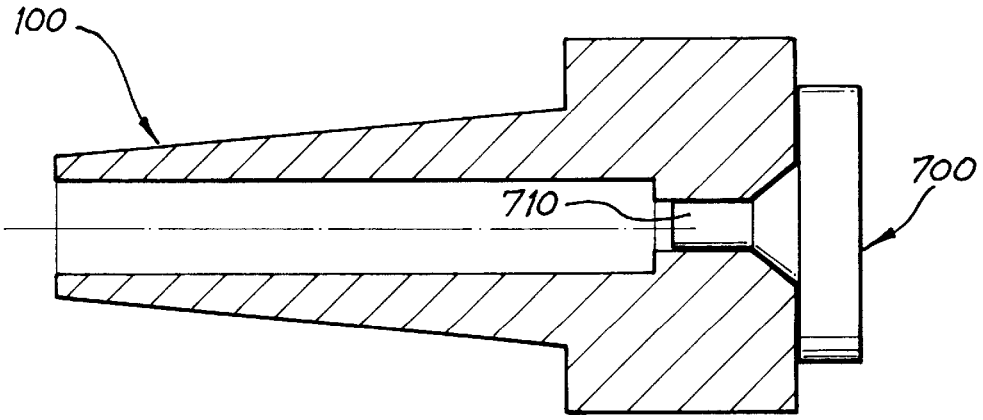
FIG. 11 is a schematic cross-sectional elevational view of the plug element of FIGS. 9 and 10 having an end plug fitted thereto.

In FIGS. 9, 10 and 11 of the accompanying drawings there is schematically depicted an alternative plug element 100. Rather than providing a discrete narrow portion, a discrete ramp portion and a widened portion, the tip portion 300 of the plug element 100 is continuously tapered from the tip 800 to the body portion 200. The plug element 100 includes a longitudinal passageway extending the whole way therethrough with a restricted portion 900 being adapted to seal tightly against the external surface of the nozzle 16 of a refill bottle 17. A frustoconical internal tapered portion 400 is sized and shaped to receive an end plug element 700 as shown in FIG. 11. The end plug 700 can have a projection 710 to fit tightly within the constriction 900. The end plug 700 serves the same function as plug 28 described above with reference to FIG. 4.

Figure 12:
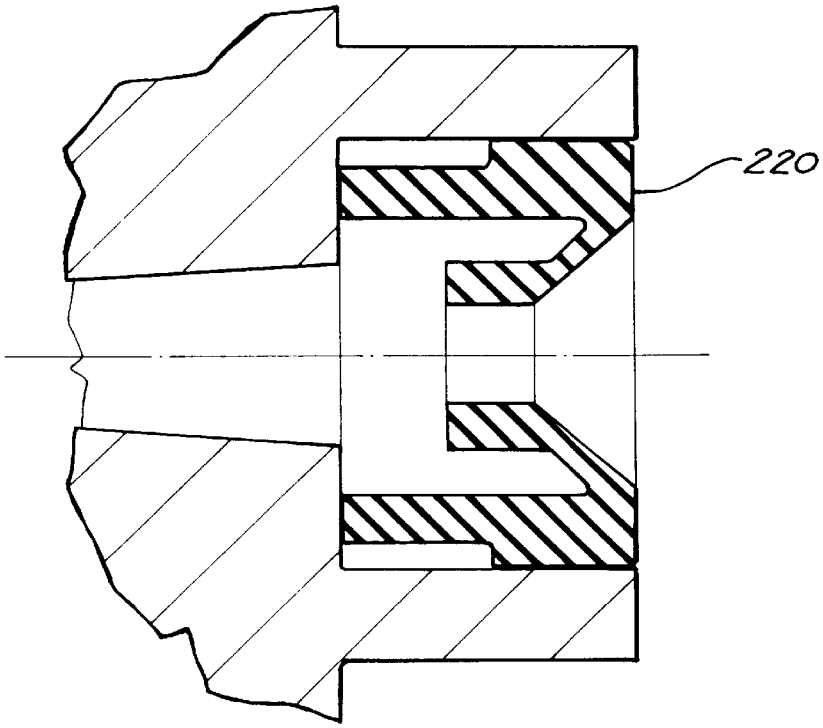
FIGS. 12 and 13 are schematic cross-sectional elevational views of a sealing washer of an ink jet cartridge both before and after insertion of filling plug 100 therein.
Figure 13:
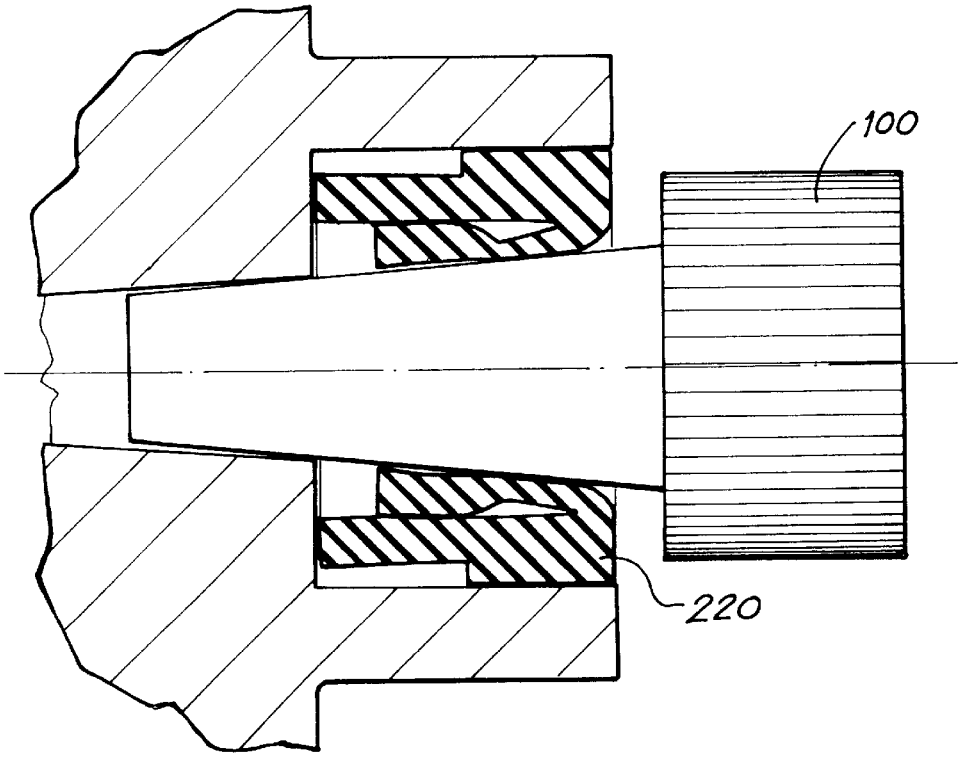

FIGS. 12 and 13 show the appearance of a sealing washer 220 both before and after insertion of the tapered tip portion 300 of filling plug 100. As can be seen in FIGS. 12 and 13, there is a void space corresponding in form with that identified as 25 in FIG. 2 which is compressed and from which entrained air forced into the body of the ink cartridge when the tapered portion 300 is inserted so as to bear against the resilient washer.

It should be appreciated that modifications and alterations obvious to those skilled in the art are not to be considered as beyond the scope of the present invention. For example, the plug elements 10 or 100 might be formed as an integral component to the lid of an ink refill bottle, rather than being provided as a separate unit.

Furthermore, whilst the above preferred embodiments relate to a single-color ink print cartridge, the invention is equally applicable to multi-color cartridges which include separate compartments, each containing a different colored ink. The method steps described above can be repeated for each of the ink compartments.

It should yet further be appreciated that the present invention is not necessarily restricted to application on Epson ink jet printers. The invention might be equally applicable to other brand printers and ink cartridges, though having similar features as are depicted in FIGS. 2 to 4, or similar.

I claim:

1. A plug element for refilling a used ink cartridge with ink, the ink cartridge having a funnel having situated therein a resiliently deformable washer having an annular void space therein which entraps air, said plug element being attached to a refiller bottle containing ink, and said plug element having:

a longitudinal extent and a passageway throughout the extent; and a tip portion and a wide portion for engaging the resilient washer when the plug element is inserted into the cartridge, said wide portion delimited from the tip portion by a ramp portion, wherein ink passes into said cartridge when the plug is inserted into the cartridge, and the ramp portion and the wide portion, upon insertion thereof into the resilient washer, deform the washer so as to expel said entrapped air from said void space.

2. The plug element of claim 1, wherein the tip portion is dimensioned so as to be sealingly received by an aperture in the ink cartridge.

3. The plug element of claim 1, wherein the plug element is circular in transverse cross-section.

4. The plug element of claim 1, wherein the ramp portion is frustoconical.

5. The plug element of claim 1, wherein the longitudinal passageway is adapted to receive a nozzle of an ink refiller bottle.

6. The plug element of claim 1, wherein the plug element is formed of a resiliently deformable material.

7. The apparatus of claim 1, wherein the entrapped air is expelled from the void space through the passageway.

8. The apparatus of claim 1, wherein the entrapped air is expelled from the void space into the cartridge.

9. The apparatus of claim 1, wherein the entrapped air is expelled from the void space through the passageway and into the cartridge.

10. A method of refilling a used ink cartridge with ink, the ink cartridge having an ink funnel having situated therein a resiliently deformable washer element defining an annular void space therein which entraps air, the method including the steps of:

forming an air hole in the ink cartridge;

inserting a plug element into funnel so as to deform the washer element and expel said air from said void space, said plug element having a passageway therethrough;

inserting a nozzle of an ink refiller bottle partly into the passageway;

injecting ink from the refiller bottle through the passageway into the ink cartridge;

removing the nozzle from the passageway; and removing the plug element from the funnel.

11. The method of claim 10, wherein upon withdrawal of the plug element, some ink from the ink cartridge is drawn back from inside the cartridge to fill the void space of the washer, thus displacing air therefrom.

12. The method of claim 10, wherein the entrapped air is expelled from the void space through the passageway.

13. The method of claim 10, wherein the entrapped air is expelled from the void space into the cartridge.

14. The method of claim 10, wherein the entrapped air is expelled from the void space through the passageway and into the cartridge.

15. A plug element for refilling a used ink cartridge with ink, the ink cartridge having a funnel having situated therein a resiliently deformable washer having an annular void space therein which entraps air, said plug element being attached to a refiller bottle containing ink, and said plug element having:

a longitudinal extent and a passageway throughout the extent; and a tip portion and a body portion for engaging the resilient washer when the plug element is inserted into the cartridge, the tip portion widening toward the body portion, wherein ink passes into said cartridge when the plug is inserted into the cartridge, and the tip portion, upon insertion thereof into the resilient washer, deforms the washer so as to expel said entrapped air from said void space.

16. The plug element of claim 15, wherein said plug element is formed of resilient plastics material.

17. The apparatus of claim 15, wherein the entrapped air is expelled from the void space through the passageway.

18. The apparatus of claim 15, wherein the entrapped air is expelled from the void space into the cartridge.

19. The apparatus of claim 15, wherein the entrapped air is expelled from the void space through the passageway and into the cartridge.

* * * * *